US007517224B2

(12) United States Patent
Fan et al.

(10) Patent No.: US 7,517,224 B2
(45) Date of Patent: Apr. 14, 2009

(54) IC SOCKET

(75) Inventors: Chia-Wei Fan, Tu-Cheng (TW); Hao-Yun Ma, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 14 days.

(21) Appl. No.: 11/818,850

(22) Filed: Jun. 15, 2007

(65) Prior Publication Data

US 2008/0096432 A1 Apr. 24, 2008

(30) Foreign Application Priority Data

Jun. 19, 2006 (TW) ..... 95210638 U

(51) Int. Cl.
*H01R 12/00* (2006.01)

(52) U.S. Cl. ..... 439/66

(58) Field of Classification Search ..... 439/66, 439/629, 71, 515, 81, 91, 862, 591, 63, 68
See application file for complete search history.

(56) References Cited

U.S. PATENT DOCUMENTS

| | | | | |
|---|---|---|---|---|
| 4,648,666 | A * | 3/1987 | Lovell | 439/71 |
| 4,664,458 | A * | 5/1987 | Worth | 439/82 |
| 2007/0077785 | A1 * | 4/2007 | Ju et al. | 439/66 |

* cited by examiner

*Primary Examiner*—Edwin A. Leon
(74) *Attorney, Agent, or Firm*—Wei Te Chung

(57) ABSTRACT

An IC socket includes a socket body (1) having a plurality of passageways (10) extending obliquely from a mating surface (101) toward a mounting surface (103). At least two terminals (2) are insertable into each of the passageways. Thus, even if the at least two terminals are laterally and obliquely movable with respect to an end of the passageway upon the pressure of the IC package toward the IC socket, effective electrical connection between the IC package and the printed circuit board are also established through the use of the IC socket due to having every two terminals of one passageway employed for electrically mating with a common contact pad of the IC package or a common conductive element (31) of the printed circuit board.

11 Claims, 7 Drawing Sheets

IC SOCKET

BACKGROUND OF THE INVENTION

1. Field of the Invention

The present invention relates to an IC socket for electrically connecting an IC package with a printed circuit board.

2. Description of the Related Art

A conventional IC socket is shown in FIGS. 4-7 to include an insulative body 1' with a passageway 10' extending obliquely through the insulative body 1', and a terminal 2' insertable into the passageway 10'. The terminal 2' includes a first contact arm 21' and a second contact arm 23' extending in parallel to each other. The first contact arm 21' and the second contact arm 23' are laterally and resiliently engagable with opposite side walls of the passageway 10' by a spring package contact section 20' formed therebetween. The spring package contact section 20' is arranged to extend above a top surface 101' of the passageway 10' for electrically mating with a contact pad 41' of an IC package 4' (in FIG. 7). The first contact arm 21' includes a board contact section 22' formed at a free end thereof and arranged to extend below a bottom surface 103' of the passageway 10' for electrically engaging with a conductive element 31' of a printed circuit board 3' (in FIG. 7). Thus, through the use of the IC socket, electrical connection is established between the IC package and the printed circuit board. When the IC package 4' is down-loaded onto the IC socket in order for electrical connection with the terminals 2' of the IC socket, an oblique movement of the terminal 2' with respect to a length axis of the passageway 10' will result in a lateral shift of the package contact section 20' or the board contact section 22' with respect to an end of the passageway 10'. This action may cause the package contact section 20' or the board contact section 22' to be laterally offset from the corresponding contact pad 41' of the IC package 4', or conductive element 31' of the printed circuit board 3', thus resulting in electrical connection failure between the terminals 2' of the IC socket and the contact pads 41' of the IC package 4', or the terminals 2' of the IC socket and the conductive element 31' of the printed circuit board 3'.

SUMMARY OF THE INVENTION

An IC socket according to an embodiment of the present invention includes a socket body defining a mating surface and an opposite mounting surface, and a plurality of passageways extending obliquely from the mating surface toward the mounting surface. At least two terminals are insertable into each of the passageways, with each terminal including a first resilient contact arm and a second resilient contact arm extending in parallel to each other. The first resilient contact arm and the second resilient contact arm are laterally and resiliently engagable with opposite side walls of the passageway by a spring package contact section formed therebetween so as to retain the terminal in the passageway. Each spring package contact section of the at least two terminals extends above the mating surface for electrically mating with a common contact pad of an IC package. The first resilient contact arm includes a board contact section formed at a free end thereof. Each board contact section of the at least two terminals extends below the mounting surface for engaging with a common conductive element of a printed circuit board. Thus, even if the at least two terminals are laterally and obliquely movable with respect to an end of the passageway upon the pressure of the IC package toward the IC socket, effective electrical connection between the IC package and the printed circuit board are also established through the use of the IC socket due to having every two terminals of one passageway employed for electrically mating with the common contact pad of the IC package or the common conductive element of the printed circuit board.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
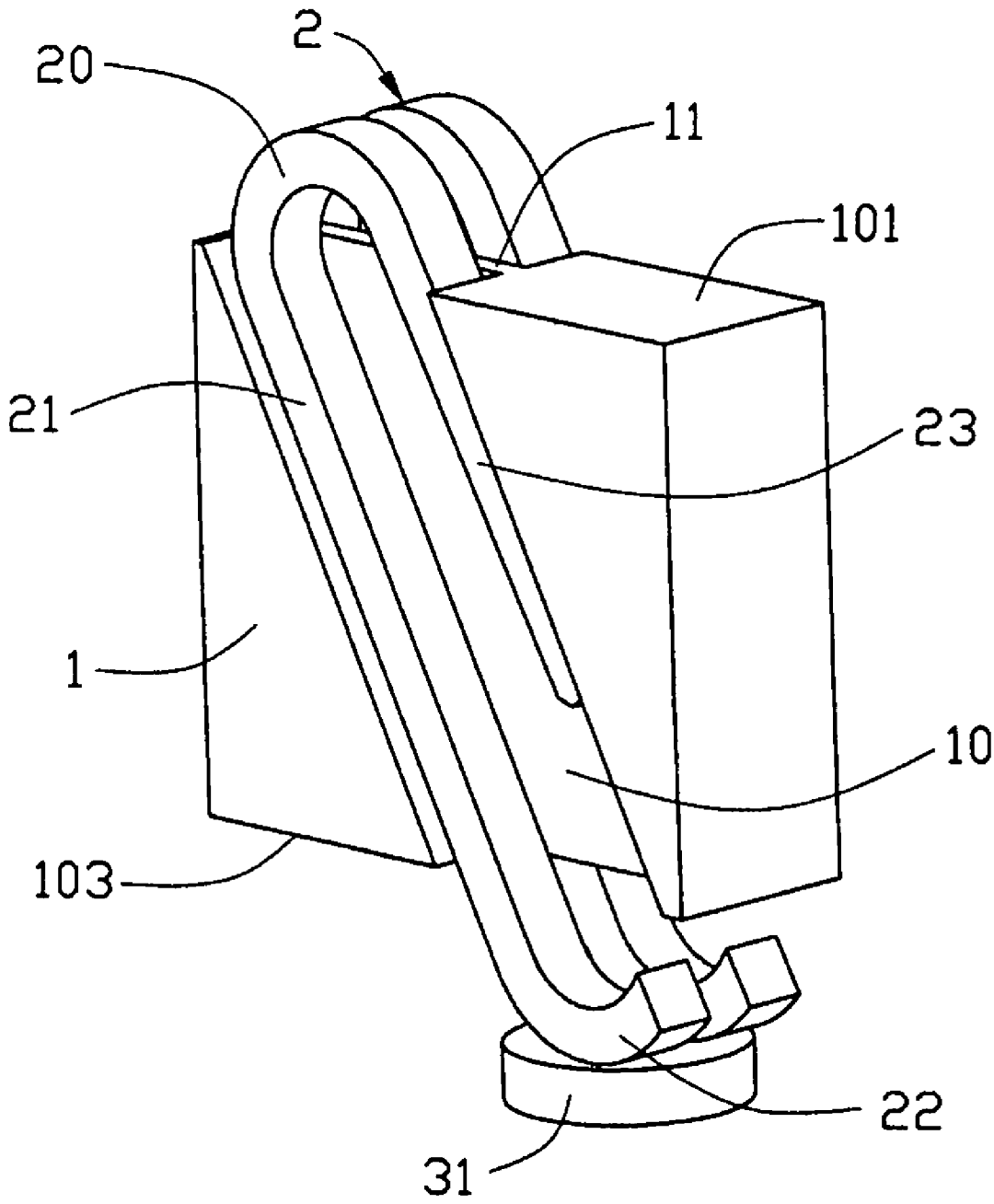
FIG. 1 is a simplified, perspective view of a part of an IC socket according to a first embodiment of the present invention.

Referring to FIG. 1, an IC socket according to the first embodiment of the present invention is partly shown to include a socket body 1, and a plurality of terminals 2 inserted into the socket body 1.

The socket body 1 defines a mating surface 101 adapted for mating with one circuit board, such as an IC package (not shown), an opposite mounting surface 103 adapted for facing another circuit board, such as a printed circuit board (not shown), and a plurality of passageways 10 extending obliquely from the mating surface 101 toward the mounting surface 103. For the purpose of illustration, merely one passageway 10 is included herein. The socket body 1 further includes a separator or divider 11 integrally attached to each of the passageways 10 for separating two terminals 2 when the two terminals 2 are commonly received within one passageway 10. The number of the separators 10 varies according to the number of the terminals 2 to be received within the passageway 10 in order for effectively holding the respective terminals in position. For example, two terminals 2 need one separator 11, three terminals 2 need two separators 11, and etc.

In this embodiment, at least two terminals 2 are insertable into each of the passageways 10. Each terminal 2 is bent from a single piece having a common width thereof, and includes a first resilient contact arm 21 and a second resilient contact arm 23 extending in parallel to each other. The first resilient contact arm 21 and the second resilient contact arm 23 are laterally and resiliently engagable with opposite side walls of the passageway 10 by a spring package contact section 20 formed therebetween so as to retain the terminal 2 in the passageway 10. Each spring package contact section 20 of the at least two terminals 2 is arranged to extend above the mating surface 101 for electrically mating with a common contact pad of the IC package (not shown). The first resilient contact arm 21 further includes a board contact section 22 formed at a free end thereof and disposed opposite to the spring package contact section 20. Each board contact section 22 of the at least two terminals 2 is arranged to extend below the mounting surface 103 for engaging with a common conductive element 31 of the printed circuit board (not shown). Thus, even if the at least two terminals are laterally and obliquely movable with respect to an end of the passageway upon the pressure of the IC package toward the IC socket, effective electrical connection between the IC package and the printed circuit board are also established through the use of the IC socket. This is so because the at least two terminals of one passageway are employed for electrically mating with the common contact pad of the IC package or the common conductive element 31 of the printed circuit board.

Figure 2:
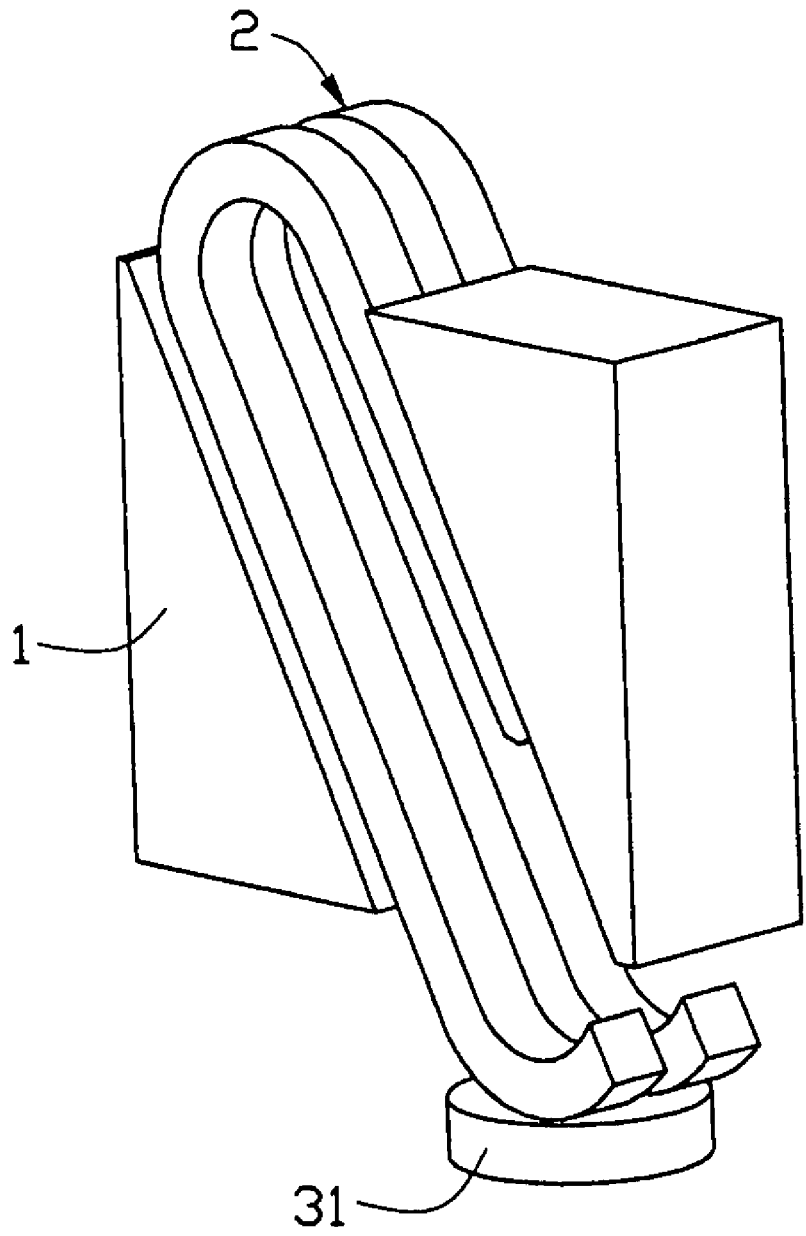
FIG. 2 is a simplified, perspective view of a part of an IC socket according to a second embodiment of the present invention.

Referring to FIG. 2, an IC socket is partly shown according to the second embodiment of the present invention. The IC socket of the second embodiment is similar to that of the first embodiment except for no use of the separator.

Figure 3:
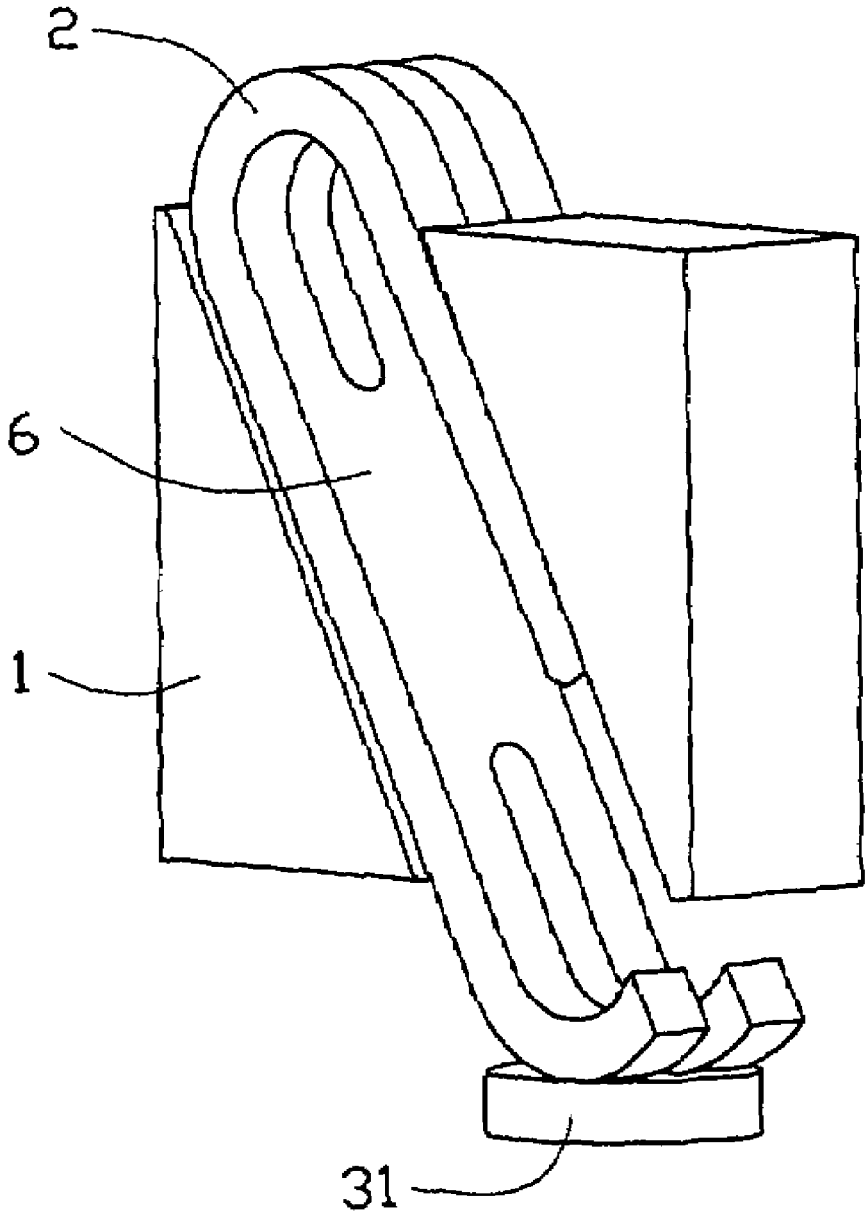
FIG. 3 is a simplified, perspective view of a part of an IC socket according to a third embodiment of the present invention.
Figure 4:
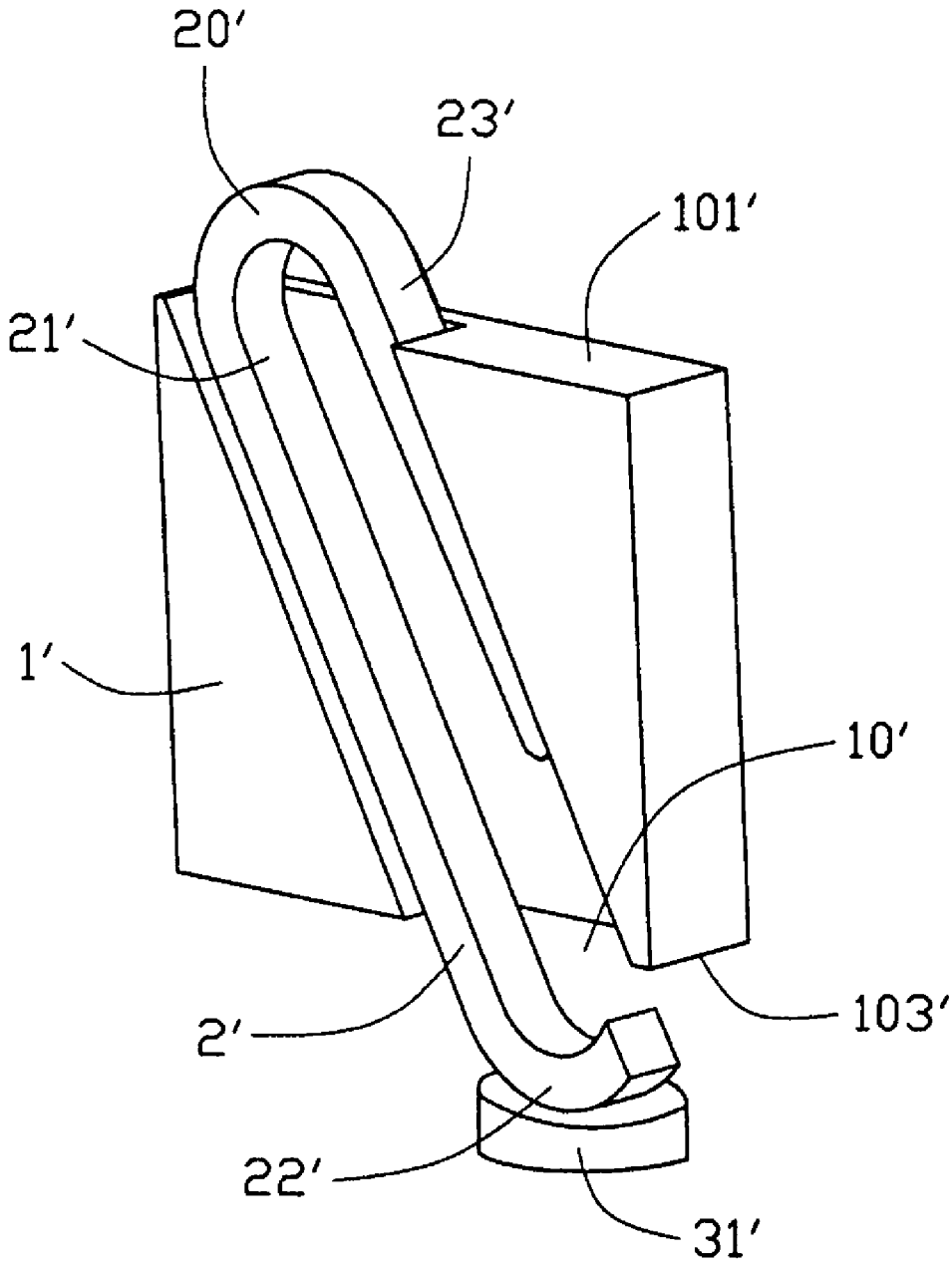
FIG. 4 (PRIOR ART)
FIG. 4 is a simplified, perspective view of a part of a conventional IC socket.
Figure 5:
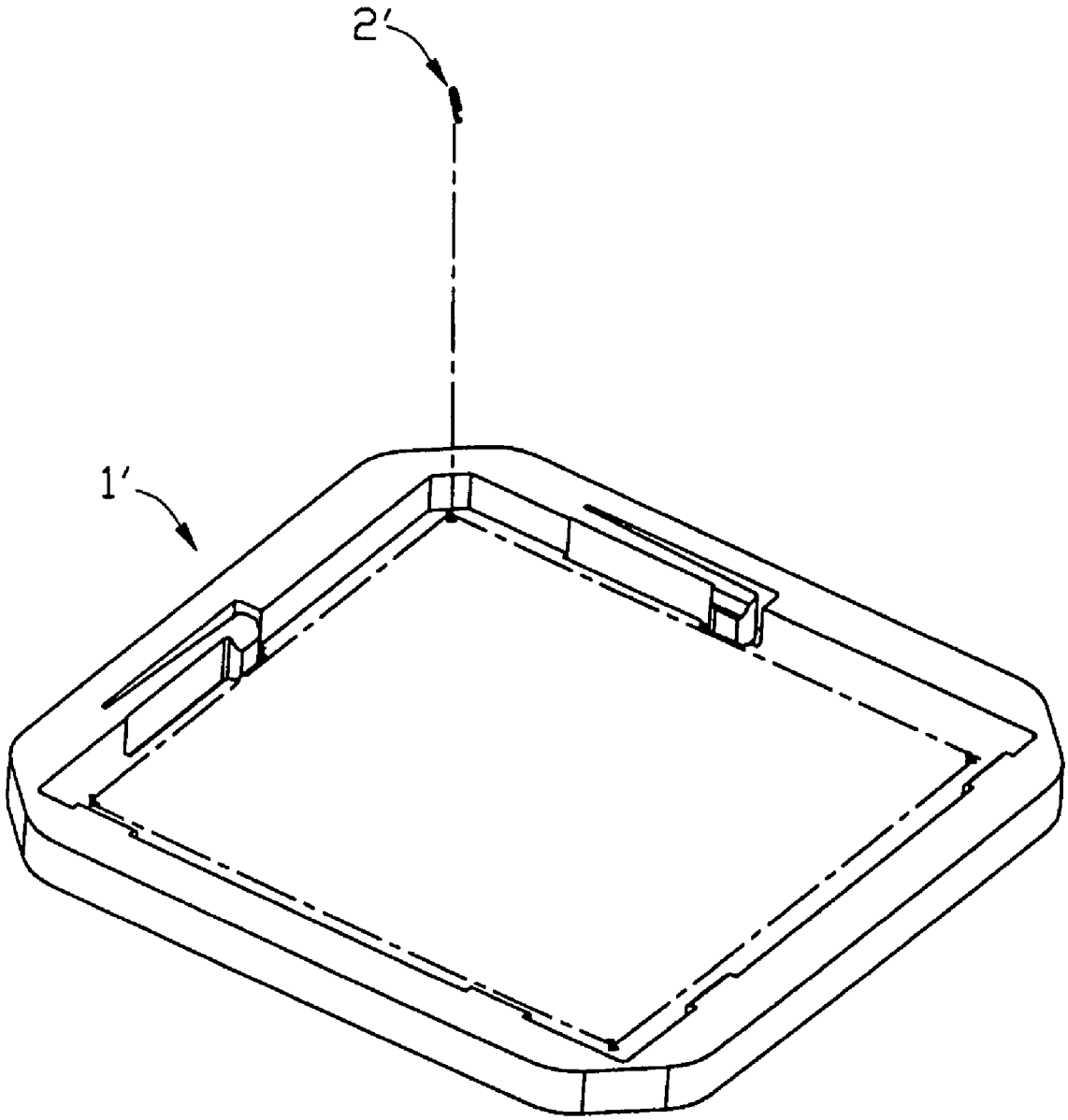
FIG. 5 (PRIOR ART)
FIG. 5 is a perspective view of the conventional IC socket of FIG. 4.
Figure 6:
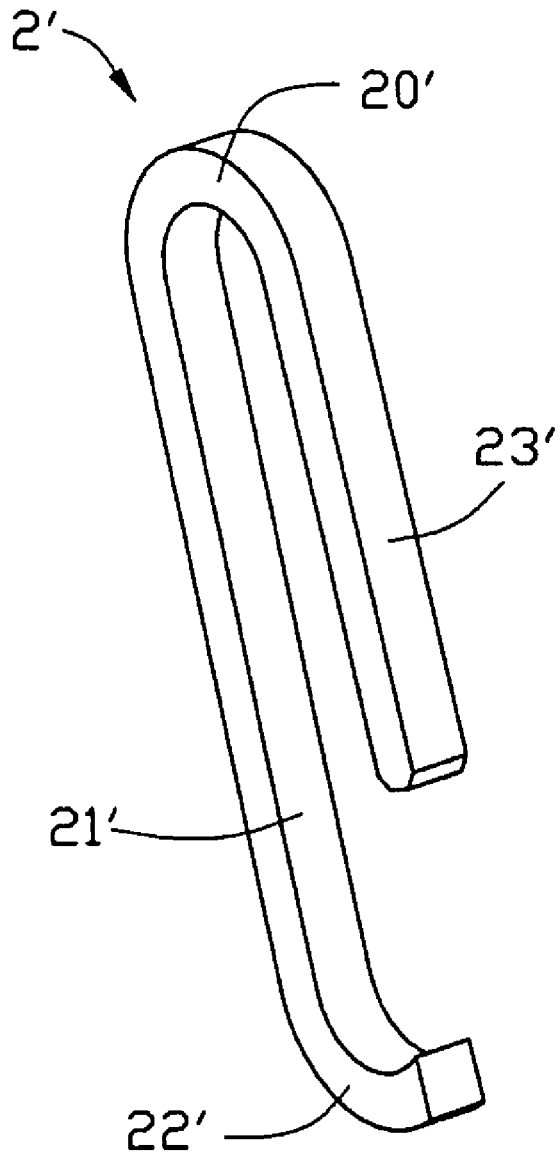
FIG. 6 (PRIOR ART)
FIG. 6 is a perspective view of a terminal of the IC socket of FIG. 5.
Figure 7:
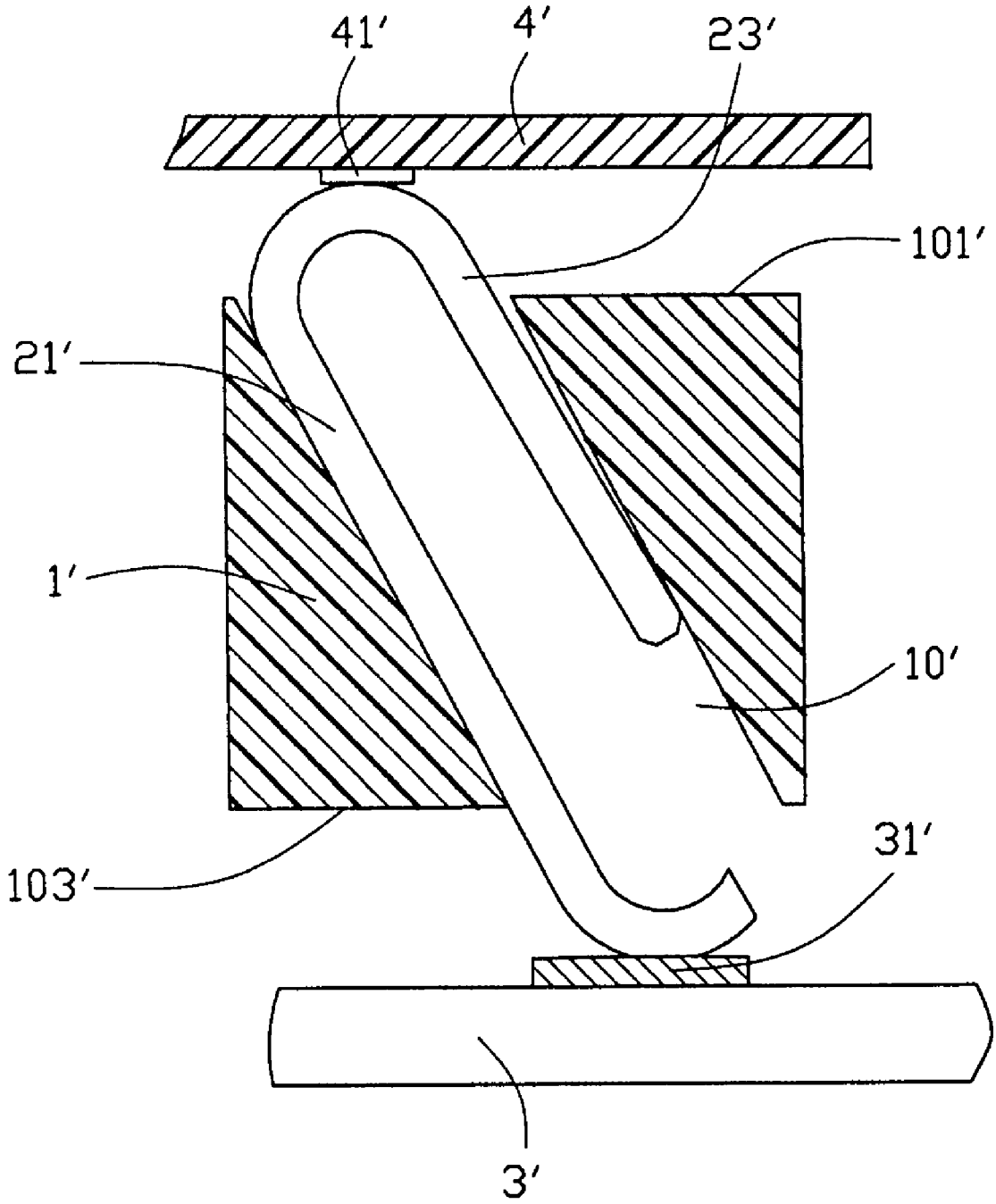
FIG. 7 (PRIOR ART)
FIG. 7 is a cross sectional view of a part of the IC socket of FIG. 5, showing the IC socket placed between two parallel circuit boards.

Referring to FIG. 3, an IC socket is partly shown according to the third embodiment of the present invention. The IC socket of the third embodiment is similar to that of the second embodiment except for the at least two terminals 2. The at least two terminals 2 are connected with each other by a middle connecting section 6 formed therebetween.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An IC socket comprising:

a socket body defining a mating surface and an opposite mounting surface, a plurality of passageways extending obliquely from the mating surface toward the mounting surface;

at least two terminals insertable into a same passageway, each terminal including a long resilient contact arm and a short resilient contact arm extending in parallel to each other, the long resilient contact arm and the short resilient contact arm laterally and resiliently engagable with opposite slanted inside walls of the passageway by a spring package contact section formed therebetween so as to retain the terminal in the passageway, each spring package contact section of said at least two terminals extending above the mating surface for electrically mating with a common contact pad of an IC package;

the long resilient contact arm further including a board contact section formed at a free end thereof and located opposite to said spring package contact section, each board contact section of said at least two terminals extending below the mounting surface for engaging with a common conductive element of a printed circuit board, wherein the long resilient contact arm and the short resilient contact arm of each terminal are floatably moved in a same direction relative to the corresponding passageway.

2. The IC socket of claim 1, wherein each terminal is bent from a single piece, which is of a common width.

3. The IC socket of claim 1, wherein said at least two terminals are physically separated from each other by a separator, which is integrally attached to the passageway.

4. The IC socket of claim 1, wherein said at least two terminals are connected with each other by a middle connecting section formed therebetween.

5. An electrical connector assembly comprising:

an insulative housing defining opposite upper and lower surfaces with a plurality of slanted passageways extending therebetween;

a plurality of discrete terminals disposed in the corresponding passageways under a condition that at least every two terminals share a same passageway in a parallel relation, each of said terminals extending above the upper and lower surfaces respectively and including parallel spring arms respectively engaging two opposite slanted interior surfaces of the corresponding passageways; wherein said at least two terminals of the passageway are moved in a same up-to-down direction relative to the passageway.

6. The electrical connector assembly as recited in claim 5, wherein each of said terminals includes a long spring arm and a short spring arm disposed in a parallel relation, with a distal end of the short spring arm located at a lower level in the corresponding passageway.

7. The electrical connector assembly as recited in claim 5, wherein the at least two terminals commonly received in the same passageway engage commonly a same exterior conductive pad.

8. The electrical connector assembly as recited in claim 5, wherein the at least two parallel terminals are attached to each other by a middle connecting section laterally attached therebetween.

9. The electrical connector assembly as recited in claim 5, wherein the insulative housing is integrally formed with a corresponding insulative partition wall in each of the passageway to mechanically and electrically separate the at least two terminals of the corresponding passageway.

10. The electrical connector assembly as recited in claim 9, wherein the insulative partition wall occupies less than one-thirds of a width of the corresponding passageway.

11. An electrical connector comprising:

an insulative housing defining opposite mating and mounting faces;

a plurality of passageways extending through the housing and between the mating face and the mounting face;

two terminals being disposed in each of the passageways while mechanically and electrically separated from each other independently by a divider which is integrally formed with the housing and separating the corresponding passageway in two spaces;

said two terminals including two respective mating sections both extending above the mating face and engaged with a same first circuit pad, and two respectively mounting sections both extending below the mounting face and engaged with a same second circuit pad so as to assure electrical connection between said first circuit pad and said second circuit pad even one of said terminals fails.

* * * * *